United States Patent [19]

Champaneria et al.

[11] 4,319,388

[45] Mar. 16, 1982

[54] TREATMENT FOR BULKED CONTINUOUS FILAMENT YARNS

[75] Inventors: Ashok J. Champaneria, Seaford, Del.; Mohinder K. Gupta, Salisbury, Md.

[73] Assignee: E. I. Du Pont de Nemours and Company, Wilmington, Del.

[21] Appl. No.: 158,611

[22] Filed: Jun. 11, 1980

[51] Int. Cl.[3] ..... D02G 1/20

[52] U.S. Cl. ..... 28/257; 28/258

[58] Field of Search ..... 28/220, 257, 258, 274

[56] References Cited

U.S. PATENT DOCUMENTS

| | | | |
|---|---|---|---|
| 3,271,943 | 9/1966 | Williams, Jr. | 28/257 X |
| 3,537,248 | 11/1970 | Berg et al. | 28/220 X |
| 3,543,358 | 12/1970 | Breen et al. . | |
| 3,563,021 | 2/1971 | Gray | 28/274 X |
| 3,703,753 | 11/1972 | Binford et al. . | |
| 3,781,949 | 1/1974 | Breen et al. . | |
| 4,069,565 | 1/1978 | Negishi et al. | 28/274 X |

FOREIGN PATENT DOCUMENTS

| | | | |
|---|---|---|---|
| 51-55414 | 5/1976 | Japan | 28/257 |
| 842762 | 7/1960 | United Kingdom . | |
| 1204676 | 9/1970 | United Kingdom | 28/258 |

*Primary Examiner*—Robert Mackey

[57] ABSTRACT

A process for making yarns bulked in a hot fluid jet more uniform in bulk comprises cooling the hot and bulked yarn on a moving screen with a water mist followed by passing the wet yarn under a tension of 0.01–0.05 gpd through a turbulent forwarding jet of steam and then through a cooling stream of air which impinges perpendicularly on the yarn while the yarn is moving under slightly greater tension of about 0.02–0.15 gpd and then wound up under normal packaging tension.

2 Claims, 1 Drawing Figure

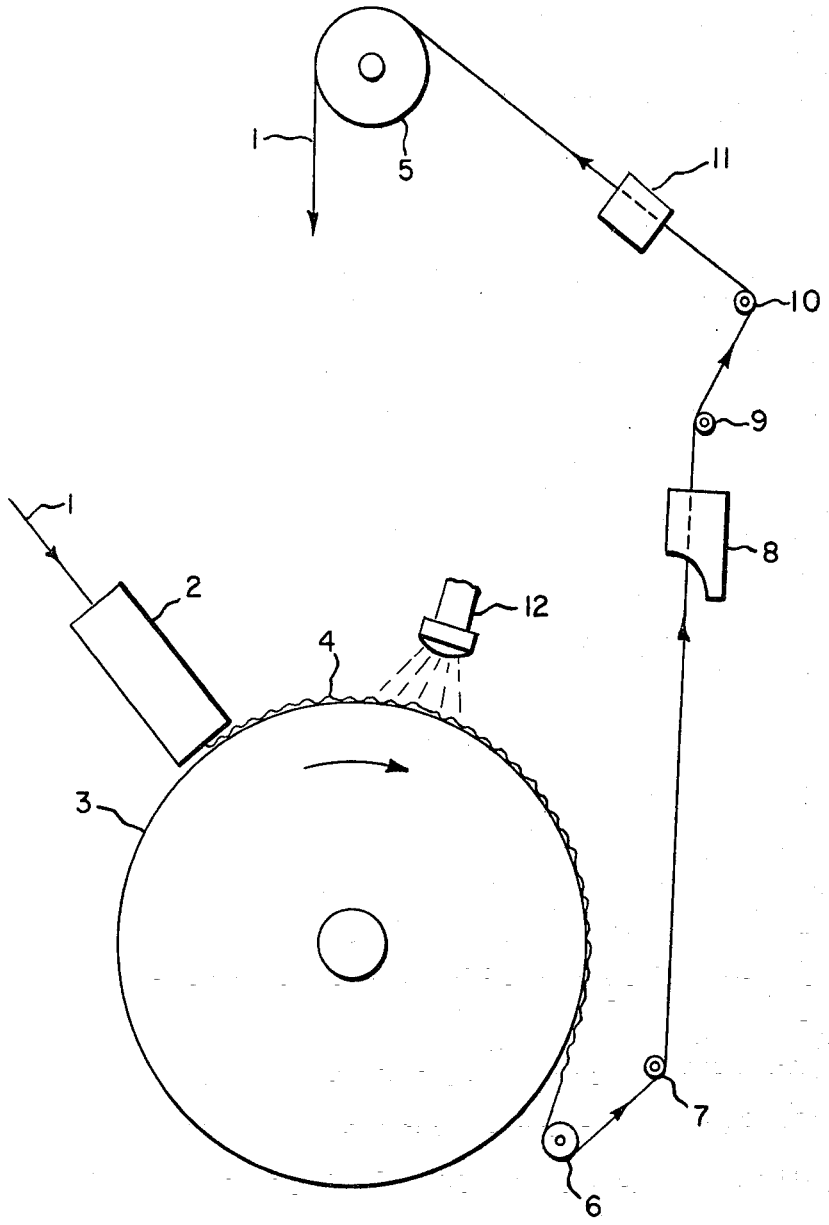
1
5
11
10
9
8
1
2
12
4
3
7
6

TREATMENT FOR BULKED CONTINUOUS FILAMENT YARNS

TECHNICAL FIELD

This invention relates to a method for improving bulk uniformity in continuous filament yarns which have been bulked by a hot fluid jet process. More particularly, it relates to a post-bulking treatment which improves the degree of uniformity along a yarn end and reduces luster streaks in carpets made therefrom.

BACKGROUND ART

Continuous filament yarns bulked by hot fluid jets have been widely used in carpets and have been particularly successful because of their distinctive random three-dimensional curvilinear crimp form which confers higher bulk to the yarns than more regular types of crimp such as helical and saw tooth crimp forms. Hot fluid jet bulking processes may be conveniently coupled with conventional spinning, drawing and winding processes for manufacturing continuous filament yarns as described for example in Breen and Lauterbach U.S. Pat. Nos. 3,543,358 and 3,781,949. The filament crimp in these yarns is straightened to a substantial degree when they are subjected to winding tension for packaging but this crimp later redevelops when the yarns are made into carpets and finished under relaxed hot-wet conditions. The redeveloped crimp then approaches the degree of crimp which the filaments had immediately after jet bulking and cooling. Whereas the bulk in the finished yarns can readily be made sufficiently uniform along and between yarns to be acceptable in many applications and in many carpet styles, certain carpet styles when dyed in critical solid colors are very susceptible to configurational streaks caused by relatively slight variations in bulk along one yarn or between adjacent yarns. U.S. Pat. No. 3,703,753 (Binford et al.) teaches one method for improving the uniformity of bulk in jet-bulked yarns by the use of a quenching jet following the bulking zone which jet both cools and pre-tensions the yarn prior to winding. Improved redevelopment of crimp in bulked yarns is also taught by British Pat. No. 842,762 wherein filaments having latent crimp are overfed into a zone of turbulent steam so that the crimp can redevelop more thoroughly. However, new methods continue to be sought for more convenient and better methods for further improving bulk uniformity in order to reduce or eliminate configurational streaks in critical carpet constructions.

DESCRIPTION OF THE DRAWING

The FIGURE is a schematic representation of a method of the invention which shows drawn continuous filament yarn 1 passing through hot fluid bulking jet 2 and being crimped and deposited on the foraminous surface of rotating bulking drum 3 where the hot yarn relaxes and cools in a crimped condition. Cooling is facilitated by a water mist sprayed from nozzle 12. Driven roll 5 removes yarn 1 from the surface of the bulking drum 3 by pulling it over stationary guides 6 and 7 which apply sufficient drag to partially straighten the filaments. Yarn 1 then passes through steam jet 8 of the dual impingement type described in Coon U.S. Pat. No. 3,525,134 and through interlacing and cooling jet 11 after passing by guides 9 and 10. After passing over driven roll 5, yarn 1 proceeds to a wind up (not shown) where it is wound into a package under conventional winding tension of approximately 0.15 to 0.30 grams/denier. Yarn 1 is fed from a source (not shown) such as from a draw roll, in the case of a coupled process, or from a supply package in a split process.

DISCLOSURE OF THE INVENTION

This invention provides an improvement in a process for bulking yarns of plasticizable filaments with compressible fluid heated to a temperature which will plasticize the filaments and jetted as a high velocity stream from an orifice, wherein the plasticizable filaments are continuously forwarded by the heated fluid while in a plasticized condition and then impinged in the jetted stream on a moving screen to remove the filaments from the heated fluid for cooling, and while on the moving screen the filaments are conveyed through a stream of cooling fluid to set crimp in the filaments, and the cooled filaments are finally taken up from the moving screen around a guide at a uniform position in the screen travel and the wetted yarn is wound under tension into a package, wherein the improvement comprises, after said yarn has been removed from the moving screen and before it is wound into said package, passing the yarn first under a tension of from about 0.01 to about 0.05 grams/denier through a turbulent forwarding jet stream of steam and second through a cooling jet stream of ambient air which impinges approximately perpendicularly upon the yarn while at a greater tension of about 0.02 to 0.15 gpd to facilitate crimp redevelopment and uniformity of bulk along the yarn.

EXAMPLE

This example demonstrates improved uniformity as provided by this invention in solid shade Saxony style carpets beck-dyed with disperse dyes.

Regular acid-dyeable yarns of 66-nylon are melt-spun, drawn and bulked with a hot air jet in a coupled process in the manner described in Breen et al. U.S. Pat. No. 3,781,949 where the hot crimped filaments are cooled on a moving screen prior to winding. Yarn cooling on the moving screen is facilitated by the use of a water mist sprayed from a nozzle 12. The yarns have a denier of about 1500 (about 1700 dtex) and contain 80 filaments having a trilobal cross section with a modification ratio of about 2.3. Duplicate test yarns are made on commercial spinning positions involving four spinning positions at one plant location and eight spinning positions at another.

Test yarns of the invention (Items CC, DD and $E^1$) are made using the method as represented by the FIGURE with a dual impingement (DI) steam jet 8 of the type disclosed in Coon U.S. Pat. No. 3,525,135 operated at a steam pressure of $9\pm2$ psig ($62\pm14$ kilopascals) and a temperature of $180\pm5°$ C. The cooling jet 11 has a cylindrical yarn passageway intersected at its center by a single air passage perpendicular to the yarn passage of the type shown in FIGS. 1 and 2 of Bunting et al. U.S. Pat. No. 3,110,151 and operated at 40 psig (276 kilopascals) pressure and at ambient temperature.

Control yarns (Items AA, FF, $A^1$, $B^1$) are prepared under identical conditions but without steam jet 8 and without cooling jet 11.

Yarns not of the invention are made for comparison as of the invention but without any mist quench (MQ) on the moving screen (Items EE, $F^1$); without the steam jet, i.e. cooling jet only (Item BB); and using a heat-setting tube in place of the turbulent steam jet 8, with and without the cooling jet (Items $C^1$ and $D^1$, respectively).

The bulked continuous filament yarns of each item are cable plied (2 ends) at 3.5 Z×3.5 S turns per inch (138×138 per meter). The yarns from the 8-position test were selected for plying randomly and the yarns from the 4-position test were selected so that no pairs of yarns were selected from the same spinning position. The plied yarns are set by the known Superba® process at 210° F. (99° C.) prebulk temperature and 280° F. (138° C.) autoclave temperature and tufted into carpets at settings of 5/32 gauge, ¾ inch (19 mm.) pile height, and 38 ounces of pile yarn per square yard (1290 grams/sq. meter) of fabric. A portion of each carpet for each item is dyed to an avocado shade with disperse dyes in a beck and with acid dyes on Kuesters continuous dyeing equipment.

Identification of the test yarn items along with bundle crimp elongation data (BCE as measured by automatic instrumentation) is summarized in Table 1. The BCE data do not themselves accurately predict best carpet performance for the invention in this test.

TABLE 1

| Test Code | Description | ABCE Data** N | X | σ | Δ |
|---|---|---|---|---|---|
| | 8-Position Test | | | | |
| AA* | Control #1 | 246 | 30.1 | 1.94 | 9.0 |
| BB* | Cold Air | 248 | 29.9 | 1.60 | 7.5 |
| CC | DI (180° C.) + Cold Air | 299 | 30.6 | 1.58 | 8.6 |
| DD | DI (230° C.) + Cold Air | 251 | 29.5 | 1.61 | 10.4 |
| EE* | DI (180° C.) + Cold Air + NoMQ | 284 | 28.0 | 2.74 | 13.8 |
| FF* | Control #2 | 314 | 30.5 | 1.68 | 8.7 |
| | 4-Position Test | | | | |
| $A^1$* | Control #1 | 80 | 29.3 | 1.85 | 7.3 |
| $B^1$* | Control #2 | 80 | 28.4 | 1.35 | 6.0 |
| $C^1$* | Heat Set Tube | 80 | 27.6 | 1.34 | 4.5 |
| $D^1$* | H.S. Tube + Cold Air | 80 | 27.9 | 1.38 | 4.9 |
| $E^1$ | DI Jet + Cold Air | 80 | 27.8 | 0.99 | 4.3 |
| $F^1$* | DI Jet + Cold Air + NoMQ | 80 | 26.8 | 1.91 | 7.0 |

*Not yarns of the invention.
**N = no. of samples; X = mathematical average value; σ = standard deviation; Δ = difference between maximum and minimum values.

The dyed carpets are subjectively ranked by a panel of experts based on the presence or absence of detectable roll-length streaks visually apparent in the carpet. The results of the ranking are summarized in Table 2.

TABLE 2

| Rank | Subjective Ranking for Uniformity* Saxony-Beck | Saxony-Kuesters | Diagnostic |
|---|---|---|---|
| | 8-Position Test | | |
| 1 | $CC^+=BB=DD^+$ | $CC^+=\underline{AA}=DD^+=\underline{FF}$ | $DD^+$ |
| 2 | | | $CC^+=\underline{FF}$ |
| 3 | | | |
| 4 | FF | | $BB=\underline{AA}$ |
| 5 | AA | BB | |
| 6 | EE | EE | EE |
| | 4-Position Test | | |
| 1 | $E^{1+}$ | $E^{1+}$ | $\underline{B^1}=E^{1+}$ |

TABLE 2-continued

| Rank | Saxony-Beck | Saxony-Kuesters | Diagnostic |
|---|---|---|---|
| 2 | $\underline{A^1}$ | $\underline{B^1}$ | |
| 3 | $D^1$ | $\underline{A^1}$ | $F^1$ |
| 4 | $\underline{B^1}=F^1$ | $D^1=F^1$ | $\underline{A^1}=C^1$ |
| 5 | | | |
| 6 | $C^1$ | $C^1$ | $D^1$ |

*Control items are underlined
+Items of the invention.

In general, the Kuesters dyed carpets are more uniform than beck dyed ones. The best Kuesters items are almost free of prominent streaks. All items except those made with the heat-set tube ($C^1$, $D^1$) and made with no mist quench (Items EE and $F^1$) are as uniform as carpets made from yarns classed "commercially acceptable" by a commercial carpet manufacturer.

In spite of the high degree of uniformity of the controls, it is apparent that items of the invention (Items CC, DD and $E^1$) perform best overall in the critical Saxony carpets and particularly for the Saxony carpets beck dyed with disperse dyes. The heat set tube items (Items $C^1$ and $D^1$), and the items with no mist quench (EE and $F^1$) are poor in uniformity.

Each test yarn is also direct tufted into a single diagnostic carpet and ranked as shown also in Table 2. Whereas these rankings do not show the items of the invention to be always superior to the controls and do not accurately predict the performance in Saxony carpets this is not unexpected since the diagnostic carpet construction results tend to be more accurate in predicting performance between lots of yarn made from the same process rather than for comparing yarns made by different processes as in this case. This is also believed to be the reason as to why the ABCE data shown in Table 1 were not found to predict carpet results.

What we claim is:

1. An improvement in a process for bulking carpet yarns of at least 1000 denier of plasticizable filaments with compressible fluid heated to a temperature which will plasticize the filaments and jetted as a high velocity stream from an orifice, wherein the plasticizable filaments are continuously forwarded by the heated fluid while in a plasticized condition and then impinged in the jetted stream on a moving screen to remove the filaments from the heated fluid for cooling, and while on the moving screen the filaments are conveyed through a cooling water mist spray to set crimp in the filaments, and the cooled filaments are finally taken up from the moving screen around a guide at a uniform position in the screen travel and the yarn is wound under tension into a package, wherein the improvement comprises, after said yarn has been removed from the moving screen and before it is wound into said package, passing the yarn first under a tension of from about 0.01 to about 0.05 grams/denier through a turbulent dual impingement forwarding jet stream of steam and then through a cooling jet stream of ambient air which impinges approximately perpendicularly upon the yarn at a greater tension of about 0.02 to 0.15 gpd to facilitate crimp redevelopment and uniformity of bulk along the yarn.

2. The process of claim 1 wherein the filaments are comprised of poly(hexamethylene adipamide) and the yarn is wound under a tension of about 0.15 to 0.30 gpd.

* * * * *

UNITED STATES PATENT AND TRADEMARK OFFICE

CERTIFICATE OF CORRECTION

PATENT NO. : 4,319,388

DATED : March 16, 1982

INVENTOR(S) : ASHOK J. CHAMPANERIA & MOHINDER K. GUPTA

It is certified that error appears in the above—identified patent and that said Letters Patent is hereby corrected as shown below:

Column 2, line 54, change the patent numeral "3,525,135" to -- 3,525,134 --.

Signed and Sealed this

*Eighteenth* Day of *May 1982*

[SEAL]

*Attest:*

GERALD J. MOSSINGHOFF

*Attesting Officer*

*Commissioner of Patents and Trademarks*